United States Patent [19]

Street et al.

[11] 3,964,109

[45] June 22, 1976

[54] FLUSH VALVE ASSEMBLY

[76] Inventors: William M. Street, P.O. Box 225, Vancouver, Wash. 98660; David L. Edmonds, 457 SW. Washington No. 5, Corvallis, Oreg. 97330

[22] Filed: June 11, 1974

[21] Appl. No.: 478,205

[52] U.S. Cl. ..... 4/67 A; 4/34; 4/57 P; 4/67 R

[51] Int. Cl.[2] ..... E03D 1/34; E03D 5/02; A61B 19/00

[58] Field of Search ..... 4/57 P, 57 R, 67 R, 4/67 A, 34, 37, 53

[56] References Cited

UNITED STATES PATENTS

| | | | |
|---|---|---|---|
| 403,926 | 5/1889 | Doherty | 4/34 |
| 934,353 | 9/1909 | Prichett | 4/67 A |
| 1,890,281 | 12/1932 | Dollinger | 4/57 R |
| 2,527,909 | 10/1950 | Bowers | 4/37 |
| 2,629,879 | 3/1953 | Bennett | 4/57 P |
| 2,709,263 | 5/1955 | Doty | 4/67 A |
| 2,716,242 | 8/1955 | Robinson | 4/37 |
| 2,754,521 | 7/1956 | Marcum | 4/57 R |
| 3,005,206 | 10/1961 | Dollinger | 4/67 A |
| 3,049,721 | 8/1962 | Taylor | 4/37 |
| 3,186,007 | 6/1965 | Falotico | 4/37 |
| 3,758,893 | 9/1973 | Smolinski et al. | 4/67 A |
| 3,766,571 | 10/1973 | Elder et al. | 4/37 |
| 3,831,204 | 8/1974 | Cook | 4/57 R |
| 3,839,747 | 10/1974 | Clark | 4/67 A |

*Primary Examiner*—Henry K. Artis
*Attorney, Agent, or Firm*—George F. Smyth

[57] ABSTRACT

A tank having an outlet conduit is provided with a valve assembly for controlling the flow of a fluid through the outlet conduit. The valve assembly includes a first valve element cooperating with a first valve seat formed by the conduit to provide a first valve. A second valve element cooperates with a second valve seat formed by the first valve element to provide a second valve. Valve opening means are pivotal on the tank to selectively open the second valve or the first and second valve to permit the discharge of fluid volumes of different magnitudes.

Both the first and second valve elements can be heavier than equivalent volumes of the fluid so a first float is provided to maintain the first valve in its open state and a second float is provided to maintain the second valve in its open state. As the surface of the fluid descends, the respective floats close their respective valves at fluid levels dependent upon the initial height of the floats in the tank. The second float can be attached to the valve opening means at any height to control the magnitude of the lesser fluid volume.

7 Claims, 5 Drawing Figures

FLUSH VALVE ASSEMBLY

BACKGROUND OF THE INVENTION

1. Field of the Invention

This invention relates generally to valve assemblies for controlling the flow of fluid from a tank and more specifically to the use of such assemblies with a toilet to selectively provide flush volumes of different magnitudes.

2. Description of the Prior Art

In the interest of conserving water, valve assemblies have been disclosed for operation with a toilet tank to provide flush volumes of different magnitudes. Such an apparatus is disclosed by Robinson in U.S. Pat. No. 2,716,242 dated Aug. 30, 1955. In this assembly, a first valve element cooperates with the valve seat associated with an outlet conduit to form a first valve. A second valve is formed by a second valve element which cooperates with a valve seat formed by the first valve element. Both the first and the second valve elements are lighter than an equivalent volume of water and therefore tend to float.

This valve assembly is operable by initially displacing the second valve element to an open position thereby permitting a first volume of the water to flow through the second valve and into the conduit. Since the second valve element is lighter than water, it remains in its open position until it descends with the surface of the water and seats on the second valve seat to inhibit further flow of the water through the second valve. Thus, the magnitude of the first volume of water is dependent upon the height of the second valve seat with respect to the initial height of the fluid in the tank.

To provide a flush with a greater volume of water, the second valve element is displaced beyond its open position to displace the first valve element to an open position displaced from the first valve seat. Fluid in the tank will then flow through the first valve into the conduit. Since the first valve element is lighter than an equal volume of water, it will remain in its open position until it descends with the surface of the water to close the first valve.

This flush valve assembly has not been particularly desirable since there has been no effective means for aligning the first valve element with the first valve seat. As a consequence, the first valve has tended to leak. This, of course, has resulted in a considerable waste of water which defeats the main purpose of a dual volume flush valve assembly. Furthermore, without an effective seat between the first valve element and the first valve seat, the fluid in the tank has not been permitted to accumulate. As a consequence, there has not been sufficient fluid in the tank to provide the next flush.

The difference in the magnitudes of the two flush volumes has been dependent upon the height of the first valve element. In order to significantly reduce the magnitude of the lesser flush volume, the first valve element has been provided with an elongated configuration providing it with a significant height within the flush tank. This elongated configuration has even further hindered the alignment of the first valve element with the first valve seat. The apparatus of the prior art have also been relatively expensive to manufacture so that the cost of the assemblies has been prohibitive for most purposes.

SUMMARY OF THE INVENTION

The flush valve assembly of the present invention is provided with alignment characteristics which facilitate the formation of effective seals. In addition, the present valve assembly can be manufactured at a relatively low cost so that the assembly is economically feasible for use with substantially any tank, such as a toilet tank.

In a preferred embodiment, a first valve element is pivotally mounted within the tank for cooperation with a first valve seat formed by the outlet conduit. A second valve element is pivotally mounted with respect to the first valve element for cooperation with a second valve seat formed by the first valve element. The pivotal mounting of the first and second valve elements provides for the alignment of these elements with the respective first and second valve seats. As a result, effective seals are formed in the first and second valves to control the flow of the water through the conduit.

The second valve element is heavier than an equal volume of the fluid in the tank but a first float is provided to maintain the second valve element in its open position until a flush having a first volume is completed. The first valve element may also be heavier than an equal volume of water in which case a second float can be provided to maintain the first valve element in its open position until a flush of a second, greater volume is completed.

The difference in the volumes of the first and second flushes is dependent upon the vertical displacement of the first and second floats at least when the tank is full of water. These volumes are not dependent upon the height of the first valve element so that its configuration need not inhibit its alignment with the first valve seat. The first float can be attached directly to a chain which forms part of the valve opening means in the tank. Furthermore, the first float can be attached to substantially any of the links in the chain to provide for variations in the relative volumes of the first and second flushes.

These and other features and advantages of the invention will become more apparent with the description of the preferred embodiments with reference to the associated drawings.

DESCRIPTION OF PREFERRED EMBODIMENTS

Figure 1:
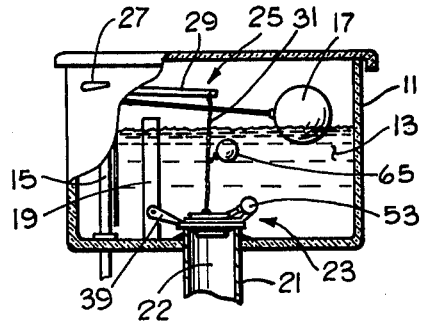
FIG. 1 is a front elevational view, partially in section, of a toilet tank filled with a fluid and a preferred embodiment of the flush valve assembly of the present invention including a first valve and a second valve for controlling the flow of the fluid from the tank.

A toilet tank is illustrated in FIG. 1 and designated by the reference numeral 11. The tank 11 is adapted to hold a large volume of fluid such as water 13. Fluid introducing means 15 is mounted within the tank 11 to introduce the water 13 into the tank 11. A tank float 17 operates with the fluid introducing means 15 to inhibit the introduction of the water 13 into the tank 11 when the surface of the water 11 reaches a predetermined level. An overflow tube 19 is typically positioned substantially vertically within the tank 11.

An outlet conduit 21 is provided near the bottom of the tank 11 and flow of the water 13 through the conduit 21 is controlled by a flush valve assembly 23 of the present invention. The outlet conduit 21 forms a passageway 22, illustrated by an arrow having the same reference numeral. The flush valve assembly 23 is operable by a valve opening means shown generally at 25. The valve opening means 25 typically includes a handle 27, pivotally mounted on the exterior of the tank 11 and operable to raise a lever 29 and chain 31 mounted within the tank 11.

It is the purpose of the valve assembly 23 to provide a first flush volume whereby only a portion of the water 13 in the tank 11 is discharged into the conduit 21, and a second flush volume whereby substantially all of the water 13 in the tank 11 is discharged through the conduit 21. Thus, the first flush volume is of a lesser magnitude than the second flush volume.

Figure 2:
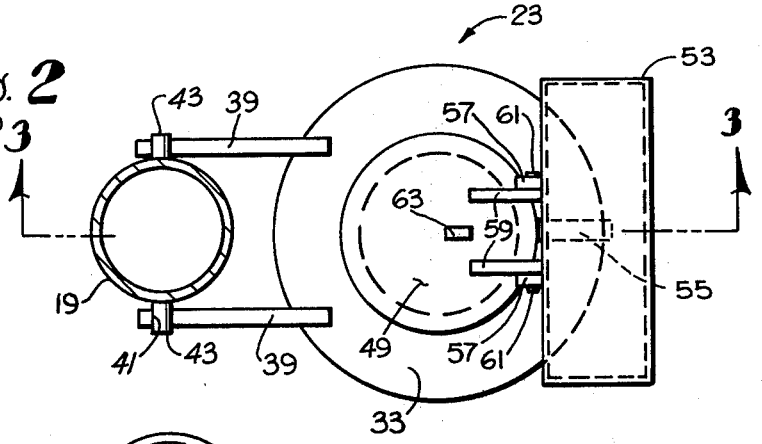
FIG. 2 is a top plan view of the flush valve assembly illustrated in FIG. 1.
Figure 3:
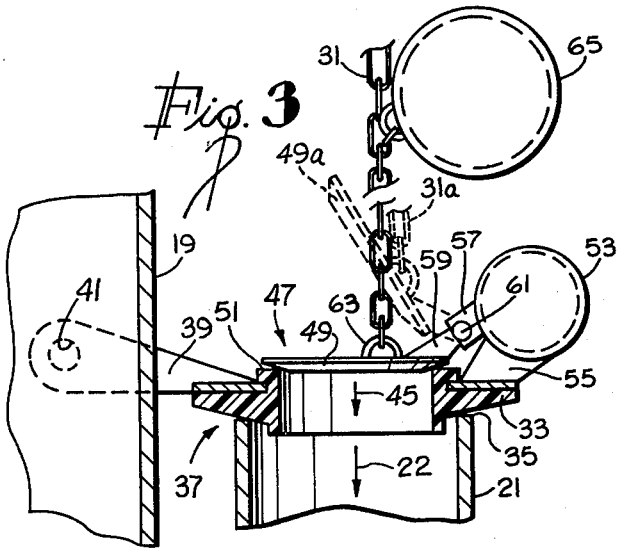
FIG. 3 is a cross-sectional view of the flush valve assembly taken on line 3—3 of FIG. 2 and illustrating the opening of the second valve.

The valve assembly 23 of the present invention is shown in greater detail in FIGS. 2 and 3. In the assembly 23, a first valve element 33 cooperates with a valve seat 35 on the top of the conduit 21 to provide a first valve 37. The first valve element 33 can be formed from any suitable material such as a resilient plastic or rubber to facilitate the formation of a seal between the first valve element 33 and the valve seat 35.

In a preferred embodiment, the first valve element 33 is supported by a pair of arms 39 which are provided with apertures 41 of suitable size to engage a pair of lugs 43 extending substantially horizontally from the overflow tube 19. Thus the first valve element 33 is pivotally mounted on the overflow tube 19 to facilitate the alignment of the element 33 with the valve seat 35. Of course the valve assembly 23 could be constructed so that the first valve element 33 pivoted on other objects within the tank 11 such as the fluid introducing means 15. In still a further embodiment, the lugs could be provided on a collar (not shown) and the collar adapted to fit around the overflow tube 19.

Portions of the first valve element 33 define a passageway 45 which is illustrated by an arrow having the same reference numeral. The passageway 45 extends into the passageway 22 defined by the conduit 21. Flow of the fluid 13 through the passageway 45 is controlled by a second valve 47. The second valve 47 typically includes a second valve element 49 which cooperates with a second valve seat 51 formed by the first valve element 33.

The second valve element 49 can be constructed of any suitable material forming an effective seal with the second valve seat 51. If the first valve element 33 is formed from a suitable resilient plastic or rubber, the second valve seat 51 can be easily formed from the same material. In this case, the second valve element 49 can be formed from any suitable resilient or non-resilient material.

It is desirable that the second valve element 49 pivot with respect to the first valve element 33 to enhance the alignment of the second valve element 49 and the second valve seat 51. In a preferred embodiment, a first float 53, described in greater detail below, is fixed to the first valve element 33 by at least one arm 55. A pair of lugs 57 extend from the float 53 in the direction of the second valve element 49. A pair of arms 59 extend from the second valve element 49 into proximity with the lugs 57. Suitable pins 61 extend between the lugs 57 and the arms 59 to provide for the pivotal movement of the second valve element 49 with respect to the float 53 and hence the first valve element 33.

In the preferred embodiment, the float 53 is positioned on the side of the first valve element 33 opposite to the arms 39. This provides the first float 53 with an extended moment arm to facilitate the maintenance of the first valve element 33 in its open position. If the second valve element 49 is constructed to pivot on the first float 53 the second valve element 49 will open in a direction opposite to that of the first valve element 33. This feature is particularly desirable since it permits the chain 31 to remain substantially above the conduit 21 during the opening of both the second valve 47 and the first valve 37. This construction provides excellent leverage for operating the valve assembly 23. In a preferred embodiment, the pivotal axes of the first and second valve elements 33 and 49 respectively, are parallel.

The chain 31 of the valve operating means 25 is typically connected to an eye 63 provided on the top of the second valve element 49. Thus, pivoting of the handle 27 raises the chain 31 to initially provide for the displacement of the second valve element 49 from the second valve seat 51. A second float 65 is preferably mounted to extend above the float 47 at least when the tank 11 is substantially full of the water 13. In a preferred embodiment, the float 65 is removably connected to one of the links forming the chain 31, although the float 65 could be connected by other suitable devices directly to the second valve element 49.

To produce the first flush volume, the handle 27 can be operated to raise the chain 31 slightly to a first position such as that shown by the dotted lines 31*a* in FIG. 3. This will cause the second valve element 49 to raise to an open position, illustrated by the dotted line 49*a* in FIG. 3, to permit the discharge of a portion of the water 13 through the passageway 45 and into the passageway 22 defined by the conduit 21. If the chain 31 is raised only to the first position shown by the dotted lines 31*a*, the first valve element 33 will remain seated on the valve seat 35 so that the first valve 37 remains in its closed position.

Figure 4:
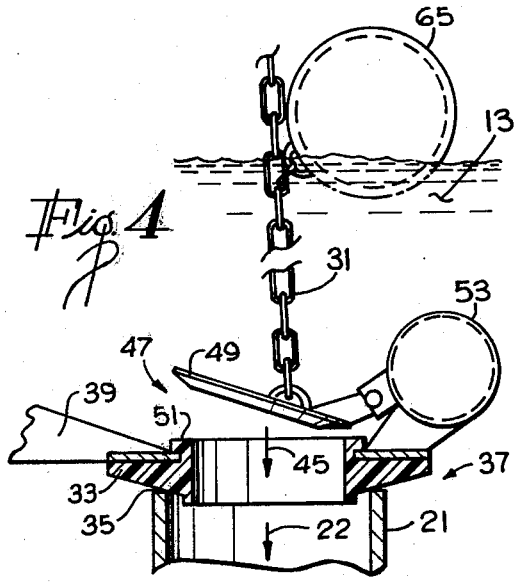
FIG. 4 is a cross-sectional view of the flush valve assembly taken on line 3—3 of FIG. 2 and illustrating the closing of the second valve.

The second valve element 49 will generally be heavier than an equal volume of the water 13 so that it will have an inherent tendency to assume its closed position. However, once the second valve element 49 is moved to its open position shown by the dotted lines 49*a*, the second float 65 will maintain the element 49 in its open position until the surface of the water 13 reaches the level of the float 65. Then the float 65 will descend with the surface of the water 13, as illustrated in FIG. 4, until the second valve element 49 seats on the second valve seat 51 to close the second valve 47. Thus only a portion of the water 13 in the tank 11 will have been discharged through the passageways 45 and 22.

It will be noted the magnitude of this first flush volume is dependent upon the level of the water 13 with respect to the level of the float 65 prior to the operation of the handle 27. Once the second valve element 49 has seated, the pressure of the water 13 in the tank 11 will maintain the seal of the second valve 47.

Figure 5:
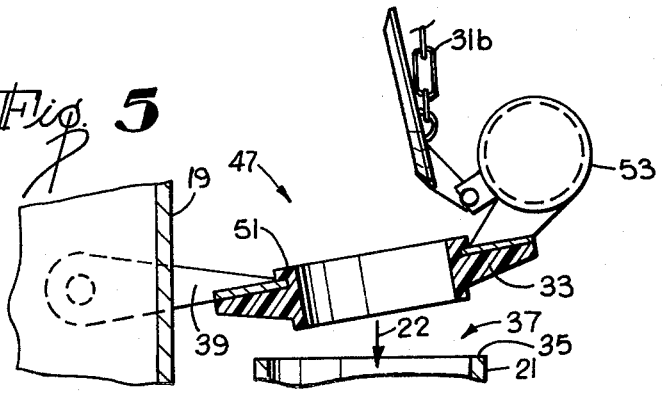
FIG. 5 is a cross-sectional view of the flush valve assembly illustrating the opening of both the first valve and the second valve.

In order to obtain the second flush volume, which is greater than the first flush volume, the handle 27 can be operated to raise the chain 31 beyond the first position shown by the dotted lines 31*a*, to a second position shown by the chain 31*b* in FIG. 5. Thus the chain 31 can be raised to the first position 31*a* to open the first valve 47 and can be further raised to the position shown by the chain 31*b* to raise the first valve element 33 from the first valve seat 35. This will enable the water 13 to flow directly into the passageway 22 defined by the conduit 21.

In this open position, the float 65 will maintain the second valve element 49 in its open position, and the first float 53 will maintain the first valve element 33 in its open position. These respective positions will be maintained until the second float 65 reaches the descending surface of the water 13 in the tank 11. Then the second float 65 will descend with the surface of the water 13 to permit the closing of the second valve 49. However, the first float 53 will continue to maintain the first valve 37 in an open state until the descending surface of the water 13 reaches the level of the first float 53. Then the first float 53 will gradually descend with the surface of the water 13 until the first valve element 33 seats on the valve seat 35.

At this point, both the first valve 37 and the second valve 47 will have achieved the closed state to inhibit any further flow of the water 13 into the conduit 21. It can be seen that the magnitude of the second flush volume is dependent upon the height of the first float 53 with respect to the surface of the water 13 prior to the operation of the handle 27.

It is of particular advantage that with the present valve assembly 23, the magnitude of the first flush volume with respect to the magnitude of the second flush volume can be varied. As noted, the magnitude of the first flush volume is dependent upon the height of the float 65 with respect to the initial surface of the water 13. Similarly, the magnitude of the second flush volume is dependent upon the height of the float 53 with respect to the initial height of the water 13 in the tank 11. Thus the relative magnitude of the first flush volume with respect to the second flush volume is dependent upon the displacement of the second float 65 with respect to the first float 53. This relative displacement can be varied by attaching the second float 65 to different links in the chain 31.

The valve assembly 23 of the present invention is of particular advantage in providing first and second flush volumes of different magnitudes. Since the valve elements 33 and 49 both pivot with respect to their associated valve seats 35 and 51, the valve assembly 23 has excellent alignment characteristics. This alignment is of particular advantage since it facilitates the formation of the seals associated with the first and second valves 37 and 47, respectively. Thus with the valves 37, 47 in their respective closed positions, the inhibiting of water flow into the conduit 21 can be assured.

This desirable feature is provided by an apparatus which can be easily constructed at a relatively low cost. The first valve element 33 need not be provided with an elongated configuration which would make it more expensive to manufacture and which would inhibit its alignment with the first valve seat 35. Furthermore, the valve assembly 23 can be used in conjunction with structures such as an overflow tube 19 and the chain 31 which are commonly available in toilets.

Although the invention has been disclosed with reference to specific embodiments, it will be apparent to those skilled in the art that the invention can be otherwise embodied so that the scope of the invention should be ascertained only with reference to the following claims.

We claim:

1. A flush valve assembly adapted to be operated by a valve opening means for controlling the flow of a fluid from a tank having an outlet conduit providing a first valve seat, the flush valve assembly comprising:

a first valve element heavier than an equivalent volume of the fluid cooperating with the first valve seat formed by the conduit to control flow of the fluid into the conduit, said first valve element defining a passage therethrough and a second valve seat;

a second valve element heavier than an equivalent volume of the fluid cooperating with said second valve seat formed by said first valve element to control flow of the fluid into said passage in said first valve element;

means for mounting said first valve element in the flush tank for pivotal movement between a closed position in which said first valve element seats against the first valve seat to inhibit the flow of the fluid through the conduit and an open position in which said first valve element is spaced from the first valve seat to facilitate flow of the fluid into the conduit;

means for mounting said second valve element on said first valve element for pivotal movement of said second valve element between a closed position in which said second valve element seats against said second valve seat to inhibit flow of the fluid into said passage and an open position in which said first valve element is spaced from the first valve seat to permit the flow of the fluid into said passage;

a valve opening means attached to said second valve element and being operable to selectively move said second valve element to the open position thereof to permit a first volume of the fluid to flow into the conduit, and being operable to selectively move said first valve element to open position thereof to permit a second volume of the fluid greater than the first volume of the fluid to flow into the conduit, a first float operatively attached to said second valve element and having characteristics for assuming a location above said second valve element, at least when the tank is full of the fluid, and for descending with the fluid in the tank to permit movement of said second valve element from the open position thereof to the closed position thereof; and a second float adapted for attachment to said first valve element and having characteristics for assuming a location above said first valve element at least when the tank is full of the fluid and for descending with the reducing level of the fluid in the tank to thereby permit movement of said first valve element from the open position thereof to the closed position thereof.

2. The flush valve assembly recited in claim 1 wherein said second valve element is pivotally mounted on said second float.

3. The flush valve assembly recited in claim 1 wherein the difference between the first volume and the second volume of the fluid is dependent upon the vertical displacement of said first float associated with said second valve element and said second float associated with said first valve element at least when the tank is full of the fluid.

4. A flush valve assembly for use in a toilet flush tank having valve opening means for controlling flow of a fluid through an outlet conduit, comprising a first valve seat, a first valve element cooperating with said first valve seat for opening and closing the conduit, said first valve means having a passage extending into the conduit and a second valve seat around said passage;

means for mounting said first valve element in the flush tank for movement between a closed position in which said first valve element is seated against said first valve seat to inhibit flow of the fluid into the conduit between said first valve element and said first valve seat and an open position in which said first valve element is spaced from said first valve seat to permit a first volume of the fluid to flow into the conduit between said first valve element and said first valve seat;

a second valve element cooperating with said second valve seat for opening and closing said passage extending through said first valve element and into the conduit, said second valve element being heavier than an equivalent volume of the fluid;

means for connecting said second valve element with said first valve element for movement of said second valve element between a closed position in which said second valve element is seated against said second valve seat to inhibit flow of the fluid into said passage and an open position in which said second valve element is spaced from said second valve seat to permit a second volume of fluid to flow into said passage extending through said first valve element;

a first float adapted for attachment to said second valve element and having properties for assuming a location above said second valve element, at least when the fluid in the tank is higher than said second valve element;

a second float connected to said first valve element and said second valve element and having properties for assuming a location above said first valve element, at least when the fluid in the tank is higher than said first valve element;

the relative magnitudes of the first volume and the second volume of the fluid being dependent upon the height of said first float in the tank and substantially independent of the height of said second valve element with respect to the height of said first valve element; and means for connecting the valve opening means to said second valve element, the valve opening means being operable to selectively move said second valve element to the open position thereof to permit the first volume of the fluid to flow into the conduit, and to selectively move said first valve element to the open position thereof to permit the second volume of the fluid to flow into the conduit.

5. The flush valve assembly recited in claim 4, wherein said first valve element is mounted in the flush tank for pivotal movement between the closed position and the open position thereof, and said second valve element is mounted on said first valve element for pivotal movement between the closed position and the open position thereof.

6. The flush valve assembly recited in claim 4 wherein the valve opening means includes a chain having a plurality of links, and said second float is connected to a particular one of said links of said chain, the relative magnitudes of the first volume and the second volume of the fluid being dependent upon the location of said particular one of said links in said chain.

7. A dual valve assembly, for use in a tank having a single valve opening means, for controlling the volume of fluid flowing through an outlet conduit leading from said tank, such a conduit having a valve seat operatively attached thereto in the tank, comprising first valve means cooperatively positionable on such an outlet conduit valve seat for controlling the flow of fluid from the tank across such a valve seat and into the conduit, said first valve means including passage means extending therethrough, from a first end locatable in direct communication with such an outlet conduit when said first value means is positioned on the outlet conduit valve seat and a second end, and valve seat means located at said second end of said passage means, means for mounting said first valve means in such a tank for movement between a closed position in which said first valve means is operatively positioned on such an outlet conduit valve seat to inhibit the flow of fluid therebetween and an open position in which said first valve means is separated from such an outlet conduit valve seat to allow the flow of fluid therebetween, second valve means cooperatively positionable against said valve seat means in said first valve means for opening and closing said passage means, means for operatively connecting said second valve means and said first valve means for movement of said second valve means between a closed position in which it is seated against said valve seat means to inhibit flow of fluid from the tank through said passage means and an open position in which said second valve means is spaced from said valve seat means to permit the flow of fluid through said passage means, first float means operatively connected to said first valve means for retention thereof in its open position until only a predetermined, relatively small volume of fluid remains in such a tank when the tank valve opening means is fully actuated, second float means operatively connected to said second valve means for retention thereof in its open position until only a predetermined, relatively large volume of fluid remains in such a tank when the tank valve opening means is either fully actuated or partially actuated, and means, connectible to such a single valve opening means and connected to said second valve means, for opening said second valve means upon partial actuation of such a valve opening means, for opening said first valve means upon full actuation of such a valve opening means, and for adjustable controlling the quantity of fluid in the relatively large volume comprising chain means having a plurality of links and means for connecting said second float means to selected ones of said links whereby the further said second float means is positioned from said second valve means, the greater is the relatively large volume of fluid.

* * * * *